United States Patent [19]

Szebényi et al.

[11] 4,416,566

[45] Nov. 22, 1983

[54] SUPPORTING APPARATUS FOR THE PROTECTION OF MINE GATE CROSSINGS

[75] Inventors: Ferenc Szebényi; János Nemeth; József Bohnert, all of Budapest; András Solymos, Tatabánya; Miklós Petrássy, Tatabánya; Tamás Kovács, Tatabánya; Jozsef Krupánszky, Tatabánya; Istvan Noll, Tatabánya, all of Hungary

[73] Assignee: Tatabanyai Szenbanyak, Tatabánya, Hungary

[21] Appl. No.: 367,841

[22] Filed: Apr. 13, 1982

[30] Foreign Application Priority Data

Apr. 13, 1981 [HU] Hungary ..... 947/81

[51] Int. Cl.[3] ..... E21D 23/00

[52] U.S. Cl. ..... 405/291; 299/32

[58] Field of Search ..... 405/291-301; 299/31, 32; 198/316, 599

[56] References Cited

U.S. PATENT DOCUMENTS

| | | | |
|---|---|---|---|
| 3,072,241 | 1/1963 | Rosenberg et al. | 299/32 X |
| 3,447,328 | 6/1969 | Schuermann | 405/291 |
| 3,504,944 | 4/1970 | Holz et al. | 299/32 |
| 3,855,805 | 12/1974 | Nakajima | 405/299 |
| 3,872,677 | 3/1975 | Linke et al. | 405/296 |
| 4,324,509 | 4/1982 | Ignatko et al. | 405/291 X |

*Primary Examiner*—Dennis L. Taylor

*Attorney, Agent, or Firm*—Gabriel P. Katona

[57] ABSTRACT

A self-advancing support apparatus for protecting mine gate crossings, and optionally for engaging the reversing/driving head of a longwall and/or gate conveyor. The support apparatus has at least two side by side desired construction but expediently of a construction identical with that of the support unit at the longwall face to which said unit is connected via a coupling element. Each unit includes a base, a canopy, and connected between them, expediently by articulation, bracing elements as well as advancing elements and holding devices mounted on the base, and if so desired, for advancing the reversing/driving head of the longwall conveyor, a guide track extending in the direction of the gate conveyor, and an actuating/controlling unit. A holding mechanism is provided for engaging the reversing/driving head of the longwall conveyor and has at least two degrees of freedom of movement. An extendible cantilever is connected to the canopy, and at least one device for directional guidance connects the units together and expediently is in the form of a jack.

9 Claims, 5 Drawing Figures

SUPPORTING APPARATUS FOR THE PROTECTION OF MINE GATE CROSSINGS

The invention concerns supporting apparatus for the protection of mine gate crossings, which may particularly advantageously be used at the crossings of longwall faces and gates.

The apparatus designated in this patent specification as 'supporting apparatus' is a self-advancing mine roof supporting apparatus containing in practice at least two units provided for each crossing which together provide the requisite support at the crossing. These units are connected to the supporting apparatus at the face and at the same time support, and on advancing, carry the reversing and driving head respectively of the face (longwall) and/or gate conveyors.

Numerous solutions are known for the protection of mine gate crossings and for the supporting and displacing of the reversing and driving heads respectively of conveyors.

In the construction, dimensioning and utilization of the various known solutions, one always starts from the given conditions and parameters in the mine, as anticipated in its details and its totality. However, these conditions are extremely difficult to predict and their determination involves great uncertainty. Consequently, in practice, the constructional solutions which have been found to be most suitable are those which have been able to match or adapt to mining or other technological requirements which may not infrequently arise and which, if not taken account of, may in given cases leads to the destruction of the crossing or to the mining machinery becoming inoperative or damaged. Such problems are for instance undercutting, deviations in levels or angle between the floor planes of the face and the gate, forced or planned deviation from the usual perpendicular orientation between the face (longwall face) and the gate etc..

In the known constructions it frequently happens that the break line of the supporting apparatus for the crossing i.e. the break line in the crossing area lags in the direction of the breakage behind the break line at the face. This may happen particularly with supporting apparatus which constructionally and functionally deviate to a greater or lesser extent from that of the supporting apparatus at the face. The legging of the break line necessarily increases the open volume of the crossing, the section to be supported is increased in size, the caving period of the crossing is increased and for all these reasons the loading and stressing of the crossing are also necessarily but inevitably increased.

This factor has added significance in circumstances where the mineral deposit is accompanied by an overburden in the form of a thick seam. In such conditions and in critical cases, the gate crossing may even become a center of rock burst.

A common characteristic of the known constructions is that they are self-advancing as a consequence of which for the crossing supporting apparatus and for the ends of the conveyors separate advancing devices, generally in the form of hydraulic cylinders or rams are included.

The largest group of known solutions are constituted by those in which the supporting apparatus for the crossing is totally different in construction from the supporting system at the work face, e.g. Nos. GB-PS 1540404, SU-PS 571609, DE-AS 23 06 802 PL-PS 97716 or where this difference is only partial, e.g. SU-PS 545747, and SU-PS 628314. To the latter group may also be assigned the supporting apparatus for gate crossings manufactured and marketed by Oroszlányi Szénbányák under the types PVK-4M and OVK-08.

In the known constructions there is an articulated connection between the main elements of the canopy and the support base, more particularly in the canopy (SU-PS 571609 and PL-PS 97716) or at the support base (Oroszlányi Szénbányák) or at both the canopy and the support base (SU-PS 575747 and DE-AS 23 06 802).

The manner of directioned guidance and direction-maintenance of the supporting apparatus during advancing is not disclosed in certain of the known constructions, such as SU-PS 571609 while other constructions are positively guided (SU-PS 545747, DAS 23 06 802) or the constructions afford a special adjusting and correction mechanism, e.g. PL-PS 97716.

It is a general characteristic of the above-mentioned known constructions that the mechanisms are complicated and intricate and are expensive to manufacture. At the same time, from the point of view of operation there is an increased likelihood of fault or damage developing and their utilize-ability is somewhat limited under varying mine conditions. Under such conditions their use may considerably reduce the safety of the work and may endanger continuous production, which can lead to besides the drop-out of expensive supporting devices, cutting machineries and conveyors, to their failure and in extreme cases to their destruction.

According to a proposal in DE-OS 1483939 (=GB-PS 1170156) the above-mentioned disadvantages are partially reduced by means of a self-advancing supporting apparatus consisting of a rear section which is identical with the supporting apparatus at the work face and a front section coupled to the rear section by an articulated connection at the roof bars and at the base plate. In comparison with the above-mentioned known constructions, this disclosure may be characterized in that the longwall conveyor is articulatedly connected with the conveyor base extending in the direction of the gate for the purposes of assuring, on the one hand optimum distance between the center line of the drive shaft of the longwall conveyor and the longitudinal axis of the gate conveyor and on the other hand to enable the driving head of the longwall conveyor to be displaced in a directionally correct manner. This construction has the further characteristic that to achieve advancing of the apparatus, advancing jacks are connected on the base structure arranged between the two supporting members. The bracing props are also disposed on this base structure and their support shoes are guided in a trapezoidal opening in guide members connected to the base.

In relation to earlier constructions this construction enables the reversing driving head of longwall conveyor to "adjust" its position to some extent but only by one degree of freedom of movement. But according to this known patent specification, the main aim of the construction was to increase the safety and reliability during advancing of the guiding of the apparatus and to provide for an arrangement of the guiding and supporting elements which renders work and displacement (advancing) more reliable, simpler and safer.

In other respects, this apparatus is relatively complicated and from the point of view of operation has several vulnerable locations, requires increased maintenance and is suitable for varying mining conditions to a very limited extent only.

The aim and the task of the present invention is to eliminate or at least to reduce the above-mentioned disadvantages of known supporting apparatuses for supporting gate crossings and to provide supporting apparatus of simpler construction and maintenance which is better able to match varying mining conditions and thus to provide more reliable, safer and more continuous operation.

The self-advancing supporting apparatus according to the invention for protection of gate crossings and further in given cases for holding the reversing driving head of the face and/or gate conveyor is constructed as follows: it consists of at least two side by side standing units; each unit is formed from any desired supporting device which expediently is identical with that employed at the face and a gate-supporting device connected to the former by way of a connecting element, the latter comprising a base, a canopy, and inbetween expediently articulatedly connected piston-and-cylinder bracing prop(s), advancing element(s) and holding mechanism(s) on the base, while, if so desired, for advancing the reversing driving head of the longwall conveyor there is provided a guiding track extending in the direction of the gate conveyor, and furthermore it includes an actuating and controlling unit,—for holding the reversing/driving head of the face conveyor a holding mechanism having at least two degrees of freedom of displacement, an extendible cantilever connected to the canopy and at least one device for directional guidance connecting the units which device is expediently in the form of a jack.

In a preferred embodiment of the invention the connecting element is arranged at the base plate and/or at the canopy. Expediently this connecting element is articulated.

In further preferred embodiments the holding mechanism may consist of an articulated connection and a rotary disc having a vertical axis of rotation and the holding mechanism may be formed as the base of the reversing/driving head of the face conveyor.

Advantageously, the guidetrack may be formed as a slide-link.

In further preferred embodiments, the extendible cantilever is constructed to correspond to the section or shape of the gate; and to adjust the 'web' of the supporting apparatus, the extendible cantilever may be provided with a working range adjustment device.

In a further preferred embodiment, the device for directional guidance is arranged, relative to the direction of advance of the supporting unit, at the front of that unit, expediently between the bases of the units and the connection(s) of the device for directional guidance may be angularly displaceably constructed.

The invention will be described, merely by way of example, with reference to a preferred embodiment illustrated in the accompanying schematic drawings, wherein.

Figure 1:
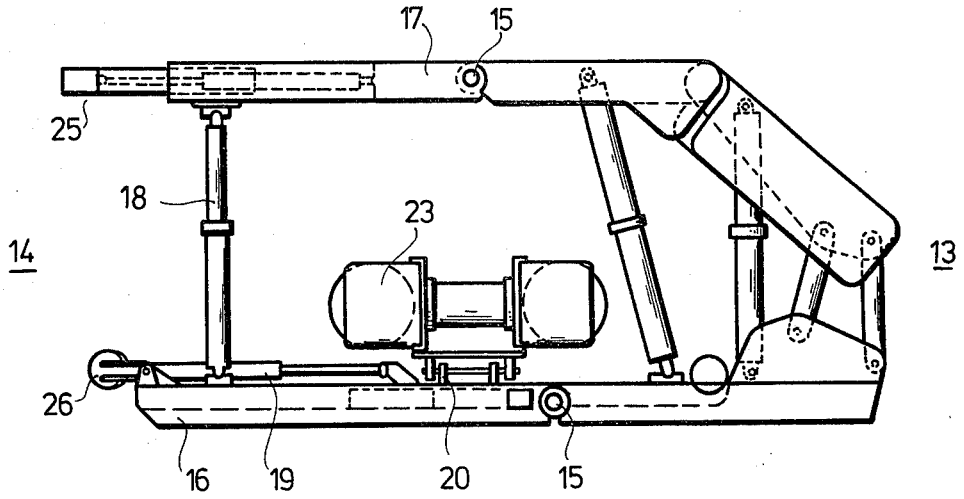
FIG. 1 is a side view of the supporting apparatus according to the invention.
Figure 2:
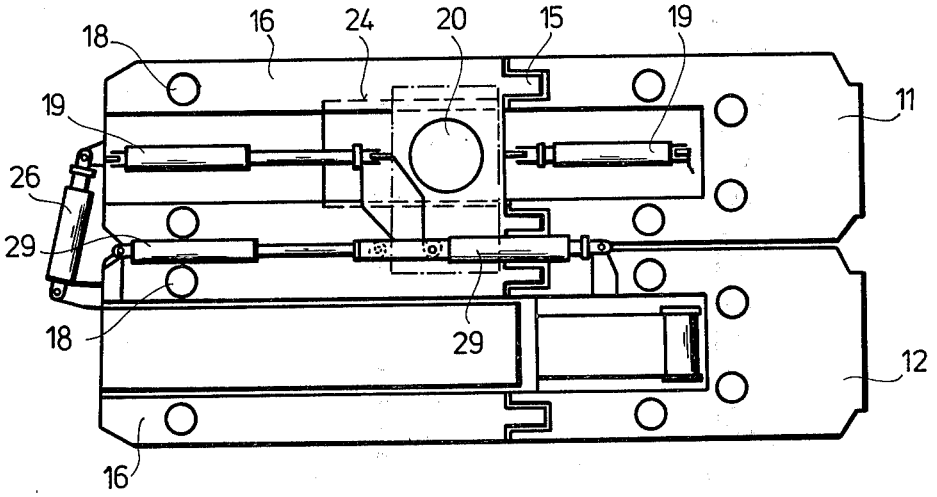
FIG. 2 is a partial plan view of the apparatus shown in FIG. 1 (but with the caps, canopies and hydraulic jacks being omitted)
Figure 3:
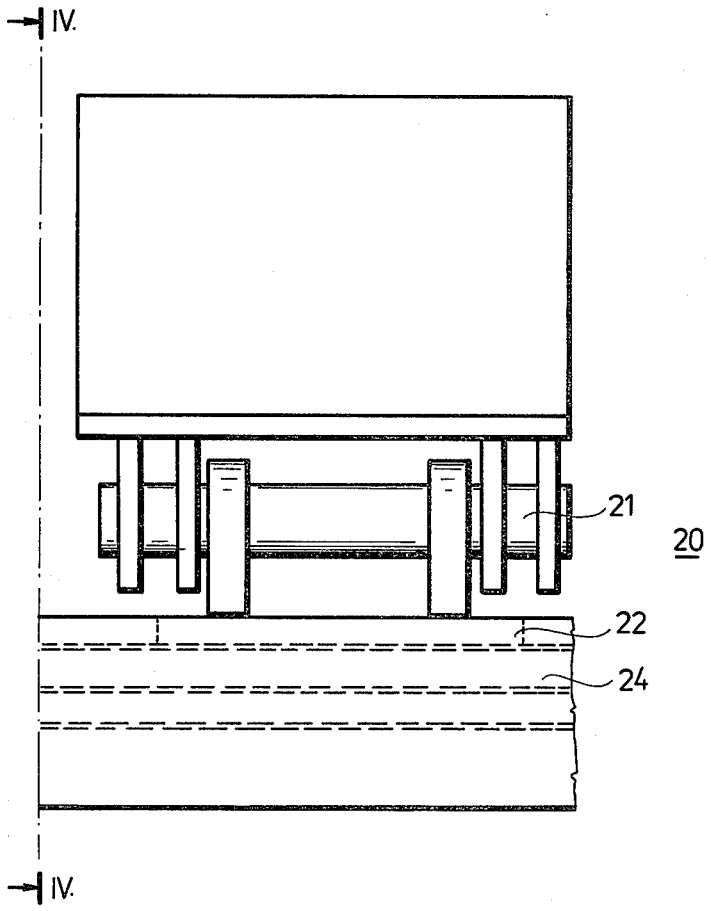
FIG. 3 is a partial front elevation on an enlarged scale of the constructional elements serving to hold the reversing/driving heads of the longwall conveyor.
Figure 4:
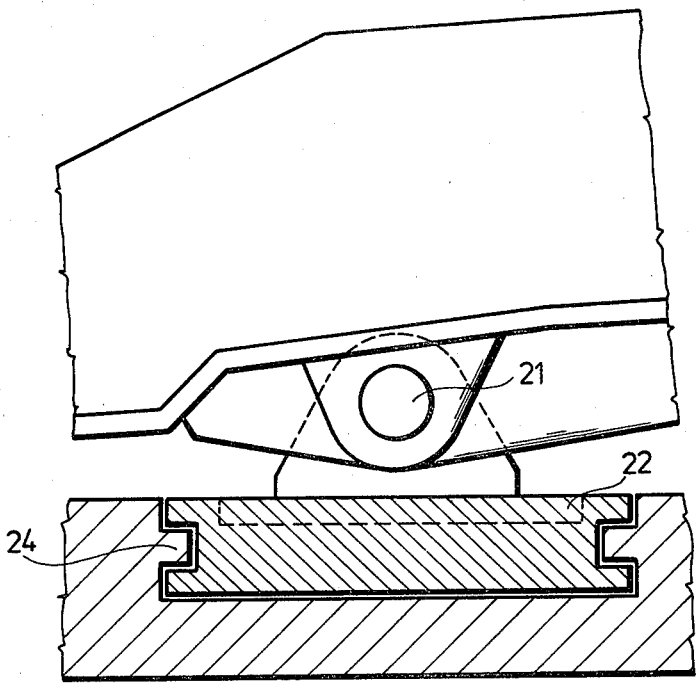
FIG. 4 is a section taken along the plane IV—IV shown in FIG. 3.
Figure 5:
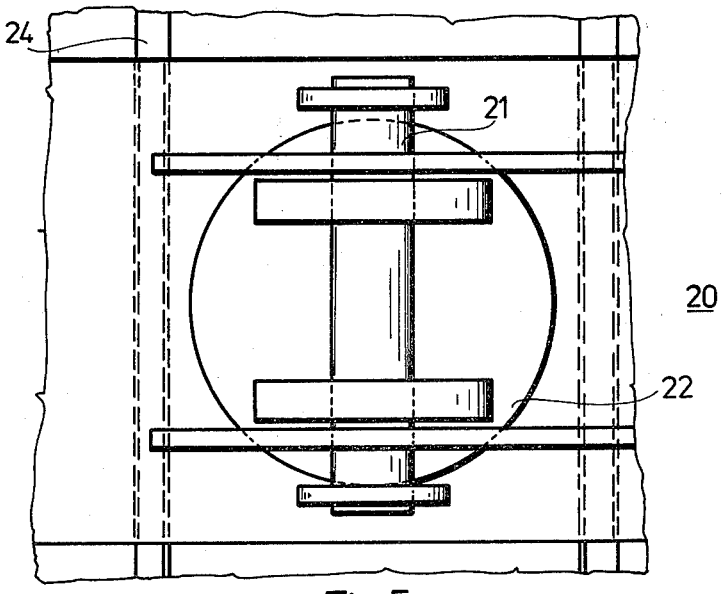
FIG. 5 is a plan view of the detail shown in FIG. 3.

The supporting apparatus shown in the illustrated preferred embodiment consists of the following elements:

The apparatus consists of two side by side units 11 and 12 each of which in turn consists of a supporting device 13 the construction of which may be of any suitable form but which is preferably identical with that of the supporting unit at the longwall face and a gate supporting device 14 connected to the supporting device 13 by way of an articulated connecting element 15. The main elements of the gate supporting device 14 are a base 16, a canopy 17 between which are connected, expediently by respective articulated connections, a pair of piston-cylinder bracing props 18 and a pair of advancing elements 19, connected preferably also articulatedly to the base 16 and formed as hydraulic rams. A holding mechanism 20 that holds the reversing/driving head 23 of the face conveyor is disposed on the base 16 the holding mechanism 20 fitting into a guiding track 24 formed as a slide-link and which has two main elements, an articulated connection 21 and a rotary disc 22, whereby to give the holding mechanism two degrees of freedom of movement.

Correspondingly, the reversing/driving head 23 can perform a rocking movement about the axis of the articulated connection 21 and with the aid of the rotary disc 22 it can be angularly displaced about a vertical axis, while finally in the course of advancing the apparatus with the aid of the hydraulic ram 29 it can be longitudinally displaced along the apparatus and then fixed in the guide track 24 formed in the base 16.

Naturally, the first two possibilities of movement can be used separately or together in accordance with the requirements of equalizing any level differences or angular deviations between the face and the gate and the location of the useful mineral deposit.

The base 16 is furthermore provided with the carriers of the gate conveyor drive head and of other non-illustrated elements of the conveyor.

An extendible cantilever 25 displaceable in the direction of advance is formed in the canopy 17, the working range of which equals to or may exceed the advancing "web" of the supporting apparatus.

Its shape expediently matches the configuration of the gate section.

The bases 16 of the units 11 and 12 are interconnected by a device for directional guidance 26, expediently consisting of a hydraulic jack, the connections of which are formed so as to be angularly displaceable, although this is not illustrated, to enable the level differences between the gate and the face and/or within the gate to be equalized.

The apparatus further includes a non-illustrated actuating and controlling unit.

The position of the connecting elements 15 and the dimensions of the bracing elements 18 should expediently be determined with due regard to ensuring that the reaction forces at the gate crossings should be equal.

The supporting apparatus according to the preferred embodiment of the invention operates as follows:

The apparatus consists of at least two side by side units 11 and 12 the supporting device 13 of each of which is fully identical with and of the same system as those of the supporting units at the face. Correspondingly, the apparatus is operated in the same system and at the same rate as the supporting apparatus at the face. Consequently, the break line of the gate supporting apparatus fully conforms with the break line at the face. The supporting device 14 connected to the supporting device 13 fully co-operates with the supporting system of the whole face by virtue of the connection between the devices 13 and 14. The actuating and controlling unit must conform with the actuating system for the whole face supporting system and must control the hydraulic props 18, advancing elements 19, the device for directional guidance 26 and the hydraulic rams 29 for moving the holding mechanism 20 in the direction of the gate.

Optionally, the gate crossing supporting apparatus may be operated with the aid of an interlock system to ensure that at any one time only one unit, say unit 11, can be advanced by releasing the props of the associated supporting device 13 and the gate supporting device 14. The other unit, in the given case unit 12, must remain fully set until unit 11 is fixed after completion of the advance.

The advancing of the units of the supporting apparatus takes place in harmony with the advance of the longwall by advancing the holding mechanism 20 along the track 24 formed in the unit 11 with the aid of the advancing element(s) 19, the face conveyor being fixed to the holding mechanism 20. After completing the advance, the prop elements of the unit 11 are released and taking support on the unit 12 the unit 11 is actuated while the hydraulic circuit deactivates the rams 19. After advancing, the unit 11 is reset at its new location, the unit 12 is released and then with the aid of the advancing elements 29, the unit 12 is advanced while taking support on the unit 11. Then, setting the unit 12 completes the positioning of the apparatus in its new position.

If required, before finally setting the units 11 and 12 in their new position, any required corrections can be effected by actuating the hydraulic jacks of the device for directional guidance 26 and the supporting device 13, and then the whole supporting apparatus is fixed by interlocking in the new position.

From the above description it would be clear that the apparatus according to the preferred embodiment of the invention is extremely simple both as regards manufacture and operation. Even under unfavorable geological and technological conditions it is able to assure continuous operation, reduction of the effects of unfavorable forces and the proper direction of the forces exerted on the apparatus.

At the same time, the unitary safety system of the longwall and the crossing can be realized by the "connectibility" of the apparatus to any longwall support system.

The illustrated embodiment described above in detail is only one example of realization, numerous other embodiments can be realized within the scope of the invention.

We claim:

1. In a self-advancing support apparatus for protecting mine gate crossings and for engaging the reversing/driving head of a longwall and a gate conveyor, the support apparatus having at least two side by side support units, each unit being formed as a longwall face support and a gate support coupled together by at least one connecting element and including a base, a canopy, tracing elements connected between them by articulation at least one advancing element and holding device mounted on the base, a guide track extending in the direction of a gate conveyor for advancing the reversing/driving head of a longwall conveyor and an actuating/controlling unit, the improvement comprising: holding means for engaging the reversing/driving head of the longwall conveyor and having at least two degrees of freedom of movement, an extendible cantilever connected to each canopy and at least one means connected to the two units together for directionally guiding same.

2. The apparatus according to claim 1, wherein the connecting element is disposed on at least one of the base and the canopy.

3. The apparatus according to claim 2, wherein in that the connecting element is an articulated one.

4. The apparatus according to claim 1, wherein the holding means comprises an articulated connection and a disc rotatable about a vertical axis.

5. The apparatus accortind to claim 1 or claim 4, wherein the holding means comprises a base.

6. The apparatus according to claim 1, wherein the guide track comprises a slide-link.

7. The apparatus according to claim 1, wherein the extendible cantilever is configured to conform to the gate cross-section.

8. The apparatus according to claim 1, wherein the means for directionally guiding is disposed at the front of the apparatus, relative to the direction of advance, and comprises a jack between the bases of the units.

9. The apparatus according to claim 1 or claim 8, wherein the means for directionally guiding is connected for angular displacement.

* * * * *